US010392569B2

(12) United States Patent
Banerjee

(10) Patent No.: US 10,392,569 B2
(45) Date of Patent: Aug. 27, 2019

(54) VACUUM GAS OIL HYDROTREATING METHODS AND UNITS

(71) Applicant: UOP LLC, Des Plaines, IL (US)

(72) Inventor: Soumendra Mohan Banerjee, New Delhi (IN)

(73) Assignee: UOP LLC, Des Plaines, IL (US)

( * ) Notice: Subject to any disclaimer, the term of this patent is extended or adjusted under 35 U.S.C. 154(b) by 37 days.

(21) Appl. No.: 15/282,512

(22) Filed: Sep. 30, 2016

(65) Prior Publication Data

US 2017/0096608 A1 Apr. 6, 2017

Related U.S. Application Data

(60) Provisional application No. 62/235,814, filed on Oct. 1, 2015.

(51) Int. Cl.
*C10G 45/00* (2006.01)
*C10G 45/04* (2006.01)

(52) U.S. Cl.
CPC ..... *C10G 45/04* (2013.01); *C10G 2300/1059* (2013.01); *C10G 2300/202* (2013.01)

(58) Field of Classification Search
CPC ..... C10G 45/00; C10G 45/02; C10G 45/04; C10G 65/00; C10G 65/02; C10G 65/04; C10G 65/14; C10G 65/16; C10G 2300/1059; C10G 2300/202; C10G 2300/4012
See application file for complete search history.

(56) References Cited

U.S. PATENT DOCUMENTS 8,574,427 B2 11/2013 Mezza et al.
2009/0159493 A1* 6/2009 Bhattacharya ..... C10G 45/02 208/58
2011/0163009 A1* 7/2011 Novak ..... B01J 23/002 208/210
2014/0144809 A1* 5/2014 Kokayeff ..... C10G 67/02 208/57
2014/0353208 A1* 12/2014 Gattupalli ..... C10G 55/06 208/88
2015/0064076 A1 3/2015 Sadler et al.

* cited by examiner

*Primary Examiner* — Prem C Singh
*Assistant Examiner* — Brandi M Doyle
(74) *Attorney, Agent, or Firm* — Paschall & Maas Law Office; James C. Paschall

(57) ABSTRACT

The present invention relates to a hydrotreating process that includes providing a vacuum gas oil stream; heating the vacuum gas oil stream; passing the heated vacuum gas oil stream to a hydrotreating reactor; passing the hydrotreated effluent to a hot separator to form a gas stream and a liquid stream; passing the gas stream to a cold separator to form a heavy liquid stream, a light liquid stream and a vapor stream; and passing the vapor stream to an amine scrubber. Aspects of certain embodiments of the present invention also relate to a hydrotreating process in which the hydrotreating reactor is operated at a pressure within the range of approximately 35-50 kg/cm$^2$g.

13 Claims, 3 Drawing Sheets

VACUUM GAS OIL HYDROTREATING METHODS AND UNITS

CROSS-REFERENCE TO RELATED APPLICATION

This application claims priority from Provisional Application No. 62/235,814 filed Oct. 1, 2015, the contents of which are hereby incorporated by reference.

BACKGROUND OF THE INVENTION

The present invention relates generally to hydrotreating processes and units, and more particularly to hydrotreating processes and units that are configured and arranged for hydrotreating a hydrocarbon feed, such as vacuum gas oil (VGO).

Hydrotreating is a hydroprocessing process used to remove heteroatoms such as sulfur and nitrogen from hydrocarbon streams to meet fuel specifications and to saturate olefinic compounds. Hydrotreating can be performed at high or low pressures, but is typically operated at lower pressure than hydrocracking.

During the hydrotreating process, hydrogen is contacted with hydrocarbon in the presence of suitable catalysts which are primarily active for the removal of heteroatoms, such as sulfur, nitrogen and metals from the hydrocarbon feedstock. Hydrotreating processes whose primary focus is the removal of sulfur are often referred to as hydrosulfurization processes. In hydrotreating, hydrocarbons with double and triple bonds may be saturated. Aromatics may also be saturated. Some hydrotreating processes are specifically designed to saturate aromatics.

BRIEF SUMMARY OF THE INVENTION

Aspects of certain embodiments of the present invention relate to a hydrotreating process that includes providing a vacuum gas oil stream; heating the vacuum gas oil stream; passing the heated vacuum gas oil stream to a hydrotreating reactor; passing the hydrotreated effluent to a hot separator to form a gas stream and a liquid stream; passing the gas stream to a cold separator to form a heavy liquid stream, a light liquid stream and a vapor stream; and passing the vapor stream to an amine scrubber.

Aspects of certain embodiments of the present invention also relate to a hydrotreating process in which the hydrotreating reactor is operated at a pressure within the range of approximately 35-50 kg/cm$^2$g.

Aspects of certain embodiments of the present invention also relate to a hydrotreating process in which the hydrotreating reactor includes at least one catalyst bed, and further wherein the at least one catalyst bed includes all metal catalysts in which the metal components, in the form of oxides, constitute between approximately 40-50 wt. % of the catalyst.

Aspects of certain embodiments of the present invention also relate to a hydrotreating process that also includes providing a diesel stream; heating the diesel stream; passing the diesel stream to a second hydrotreating reactor; and passing the hydrotreated effluent of the second hydrotreating reactor to the hot separator, whereby the hydrotreated effluent of the second hydrotreating reactor is combined with the hydrotreated effluent of the first hydrotreating reactor, thereby forming the gas stream and the liquid stream.

Aspects of certain embodiments of the present invention also relate to a hydrotreating process including providing a vacuum gas oil stream; heating the vacuum gas oil stream; passing the heated vacuum gas oil stream to a hydrotreating reactor; hydrotreating the heated vacuum gas oils stream under hydrotreating conditions and at a pressure within the range of approximately 35-50 kg/cm$^2$g to form a hydrotreated effluent; and passing the hydrotreated effluent to a hot separator to form a hot separator gas stream and a hot separator liquid stream, wherein the hot separator includes a pump around circuit that removes a pump around liquid stream from an upper portion of the hot separator via a pump around line, and further wherein the pump around liquid stream is cooled to form a cooled stream, which is routed back into the hot separator at an elevation above where the pump around liquid stream exited the hot separator.

Aspects of certain embodiments of the present invention also relate to units for performing the processing described herein.

BRIEF DESCRIPTION OF THE SEVERAL VIEWS OF THE DRAWINGS

Preferred embodiments of the present invention are described herein with reference to the drawings wherein.

DETAILED DESCRIPTION OF THE INVENTION

Figure 1:
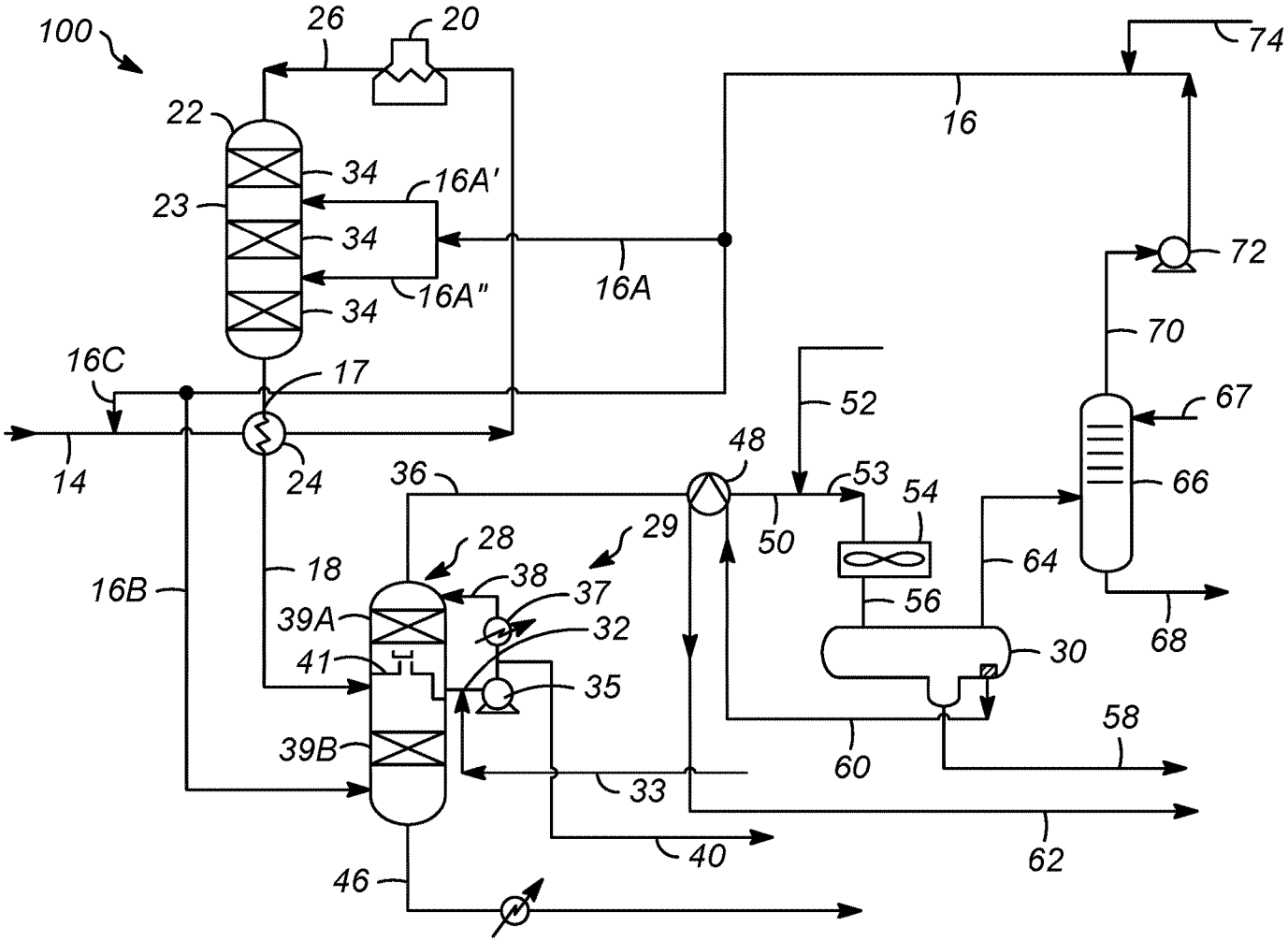
FIG. 1 depicts an example of a first embodiment of the present invention.

Currently, there are many refineries around the world that include low pressure diesel hydrodesulfurization (DHDS) units that were designed and built to meet the low sulfur specifications that were introduced in many countries in the 1990's. However with the introduction of more stringent cetane specifications, these units lost their importance as the cetane boost achieved across these low pressure DHDS units was minimal. The typical operating pressure of such units is in the range of 35-50 kg/cm$^2$g.

The present invention provides an alternate use of these DHDS units, which can be modified to process another type of hydrocarbon stream, such as vacuum gas oil (VGO). With increased processing of heavier crudes, the VGO yield has gone up and the secondary processing units like fluidized catalytic cracking (FCC) units and hydrocracking units (HCU) are being pushed to their capacity limits. Hence, the present invention provides a way of utilizing the existing assets of the DHDS units, with modifications, to pre-treat the VGO so that their processing in the secondary units like FCC units and HCUs becomes easier. The present invention allows for the majority of the sulfur (S) and Nitrogen (N) contaminants to be removed in the low pressure unit, which reduces the load on the FCC unit and HCU, which makes processing of additional feed in these units easier.

In embodiments of the current invention, the use of an all-metal hydrotreating catalyst is proposed for these low pressure DHDS reactors. With an all-metal catalyst (containing metal oxides of cobalt, molybdenum, tungsten, nickel, etc.), effective desulfurization and denitrification of the VGO can be achieved at low operating pressures.

Normally, these low pressure DHDS units do not have a hot separator in the configuration. While processing VGO, embodiments of the present invention include a hot separator in the process scheme. In certain embodiments, the hot separator liquid is directly routed to the downstream HCU or FCC unit for further processing. A pump around circuit is preferably provided in the top section of the hot separator, which ensures that material boiling above the diesel range does not go to the hot separator overhead vapor circuit. The DHDS units normally have low recycle gas rates, and hence some modification in the recycle gas circuit might be required to meet the recycle gas rates needed to process VGO.

The all metal catalyst mentioned in this invention can consist of a Group VI metal component selected from molybdenum, tungsten, and mixtures thereof, a Group V metal component selected from vanadium, niobium, tantalum, and mixtures thereof, and a Group VIII metal component selected from nickel, cobalt, iron, and mixtures thereof. The metal components (in the form of oxides) preferably constitute up to 40-50 wt. % of the catalyst.

In certain embodiments, there are two reactors, which enables co-processing of a VGO stream and a diesel stream. For the reactor processing the diesel stream, the last catalyst bed can preferably incorporate a high metal containing catalyst, which will help in aromatic saturation, and hence increase the cetane index of the diesel.

In certain other embodiments, a separate stripper is installed for the hot separator bottoms. The stripped and treated VGO is cooled, and then treated with ionic liquid. The ionic liquid treating further reduces the nitrogen, metals and CCR (Conradson Carbon Residue) of the VGO, and makes it easier to process in the downstream HCU and FCC unit. The ionic liquid used can be, for example, imidazolium-based, phosphonium-based, or guanidinium-based.

Turning now to the figures, several different embodiments of the present invention are shown and will be described. In the descriptions of the various embodiments, certain common components, such as valves, pumps, controllers, heat exchangers, etc., may be shown in the drawings, but need not be described as the operation of the these components should be clear to one of ordinary skill in the from a review of the drawings. Likewise, such common components may be omitted from the drawings, but one of ordinary skill in the art would understand the proper placement and operation of such components, as necessary.

Referring to FIG. 1, an exemplary hydrotreating system 100 of the first embodiment of the present invention is shown. System 100 of this embodiment, as well as the systems of the other embodiments, may also be considered as hydrosulfurization systems. In accordance with an embodiment, and as shown in the exemplary hydrotreating system 100 of FIG. 1, the hydrotreating system 100 preferably includes, inter alia, a heating apparatus 20, a hydrotreating unit 22, a hot separator 28, and a cold separator 30.

The hydrotreating system 100 is configured for fluid communication with a hydrocarbon feed source, such as a source of vacuum gas oil (VGO), via hydrocarbon feed stream 14. In this embodiment, the feed stream is mixed with a carrier gas stream 16C, which may be provided from within the system itself, as described below. However, it is to be appreciated that in other embodiments, the hydrocarbon feed stream 14 may be provided from a feed source that is pre-mixed with the carrier gas stream 16C. The carrier gas stream 16C comprises hydrogen that is consumed during hydrotreating and that reacts with the heteroatoms that are present in the hydrocarbon feed stream 14. The hydrogen in the carrier gas stream 16C may also be provided from a fresh hydrogen feed (not shown).

The terms "vacuum gas oil," "VGO," and similar terms relating to vacuum gas oil as used herein are to be interpreted broadly to receive not only their ordinary meanings as used by those skilled in the art of producing and converting such hydrocarbon fractions, but also in a broad manner to account for the application of the presently described processes to hydrocarbon fractions exhibiting VGO-like characteristics. Thus, the terms encompass straight run VGO, as may be produced in a crude fractionation section of an oil refinery, as well as VGO product cuts, fractions, or streams that may be produced, for example, by coker, deasphalting, and visbreaking processing units, or which may be produced by blending various hydrocarbons.

In general, VGO comprises petroleum hydrocarbon components boiling in the range of from about 100° C. to about 720° C., where T5=362° C. and T95=538° C., using ASTM D1160. In an embodiment, the VGO boils from about 250° C. to about 650° C. and has a density in the range of from about 0.87 to about 0.95 g/cm$^3$. In another embodiment, the VGO boils from about 95° C. to about 580° C.; and in a further embodiment, the VGO boils from about 300° C. to about 720° C. Generally, VGO may contain from about 100 to about 30,000 ppm-wt nitrogen. In an embodiment, the nitrogen content of the VGO ranges from about 10 to about 20000 ppm-wt.

As alluded to above, the hydrocarbon feed stream 14 is heated. In particular, the hydrocarbon feed stream 14 is heated prior to introduction to a hydrotreating process, which may occur, for example, in the hydrotreating unit 22. In an embodiment, the hydrocarbon feed stream 14 is brought up to a desired inlet temperature for the hydrotreating process (which, in certain embodiments, is within the range of approximately 350° C. to approximately 410° C.). The desired inlet temperature may be influenced by various factors including the age or state of catalyst used in the hydrotreating process, types and amounts of heteroatoms present in the hydrocarbon feed stream 14, and other factors that are known in the art. In accordance with an embodiment, and as shown in the hydrotreating system 100 of FIG. 1, the hydrocarbon feed stream 14 is heated in the heating apparatus 20, which may be a fired heater. More specifically, the heating apparatus 20 heats the hydrocarbon feed stream 14 prior to introduction to the hydrotreating unit 22. In this embodiment, the carrier gas stream 16C is preferably present with the hydrocarbon feed stream 14 during heating in the heating apparatus 20 so that the mixture of the carrier gas stream 16C and the hydrocarbon feed stream 14 is uniformly heated to the desired inlet temperature for the hydrotreating process.

Preferably, the hydrotreating system 100 may also include a heat exchanger 24 upstream of the heating apparatus 20, with the mixture of the hydrocarbon feed stream 14 and the carrier gas stream 16C passing through the heat exchanger 24 prior to heating in the heating apparatus 20. In this regard, the step of heating the mixture of the hydrocarbon feed stream 14 and the carrier gas stream 16C may further include the step of passing the mixed stream through the heat exchanger 24. When the heat exchanger 24 is used, effluent 17 from the hydrotreating unit 22 may be fed through the heat exchanger 24 to heat the mixture of the hydrocarbon feed stream 14 and the carrier gas stream 16C.

Once heated via the heat exchanger 24 and the heater 20, or by other desired heating means, the heated hydrocarbon feed stream 26 is introduced to the hydrotreating process. In an embodiment, as shown in FIG. 1, the heated hydrocarbon feed stream 26 is introduced to the hydrotreating unit 22 from the heating apparatus 20, where it is preferably vaporized and heated to the required temperature. In this embodiment, the heated stream 26 is introduced directly from the heating apparatus 20 to the hydrotreating unit 22. However, it is to be appreciated that in other embodiments, intervening treatment steps may occur between the heating apparatus 20 and the hydrotreating unit 22.

Any appropriate hydrotreating process that is known in the art may be employed in the methods and systems described herein. For purposes of the instant application, "hydrotreating" refers to a process where a feed that contains heteroatoms (e.g., a vacuum gas oil (VGO) feed) and a hydrogen-containing gas (e.g., the carrier gas) react in the presence of suitable catalysts for the removal of heteroatoms, such as sulfur and nitrogen, from the feed. In an embodiment, the hydrotreating process may include multiple stages, with different feed, catalysts, or reaction conditions existing within the various stages. In this embodiment, the heated hydrocarbon feed 26 is introduced to a first stage, although it is to be appreciated that the heated feed may also be introduced to one or more later stages downstream of the first stage in addition to the first stage. In one embodiment, the heated hydrocarbon feed 26 is only introduced to the first stage.

The exemplary hydrotreating system 100 of FIG. 1 may be used for the hydrotreating method, in which circumstance the hydrotreating process occurs in the hydrotreating unit 22 under hydrotreating conditions and at an operating pressure within the range of approximately 35-50 kg/cm$^2$g. In preferred embodiments, the hydrotreating conditions include relatively low temperatures (such as between approximately 370° C. and approximately 390° C.) and relatively low pressures (35-50 kg/cm$^2$g) such that hydrocracking reactions are not initiated within the hydrotreating unit 22. The hydrotreating unit 22 may contain a single or multiple reactor vessels 23, and each reactor vessel 23 may contain one or more zones, with each zone including at least one catalytic bed 34. The stages referred to in the hydrotreating process above may exist in separate reactors (not shown), or may exist in zones within a single reactor vessel 23. For example, in one embodiment, the hydrotreating unit 22 includes a fixed-bed hydrotreating reactor vessel 23.

A quench gas, such as a gas stream including hydrogen, is also preferably provided to the hydrotreating reactor vessel 23 to be used during the hydrotreating process. In particular, a quench gas feed stream 16A, which may be divided into a plurality of streams such as 16A', 16A", may be provided to the vessel 23 at different elevations. The quench gas feed stream 16A in this embodiment originates from stream 16, which will be described below. However, the quench gas feed stream(s) may originate from other sources as well. Further, although two quench gas streams at two different elevations are shown in FIG. 1, a single stream may be provided, or three or more streams may also be provided at three or more different elevations.

The catalytic beds 34 in the various zones of the fixed-bed hydrotreating reactor vessel 23 may include the same or different hydrotreating catalysts. Suitable hydrotreating catalysts for use herein are any known conventional hydrotreating catalyst and include all metal catalysts such as those that are comprised of a Group VI metal component selected from molybdenum, tungsten, and mixtures thereof, a Group V metal component selected from vanadium, niobium, tantalum, and mixtures thereof, and a Group VIII metal component selected from nickel, cobalt, iron, and mixtures thereof. The metal components (in the form of oxides) preferably constitute up to 40-50 wt. % of the catalyst. It is within the scope herein that more than one type of hydrotreating catalyst be used in the same reaction vessel. Of course, the particular hydrotreating catalysts and operating conditions may vary depending on the particular hydrocarbons being treated and other parameters, as known in the art.

After the hydrotreating reaction is performed within the hydrotreating unit 22, the effluent stream 17 passes through the heat exchanger 24, where some of the heat of stream 17 is removed and is provided to the mixture of the carrier gas stream 16C and the hydrocarbon feed stream 14, as discussed above. This slightly cooled effluent stream 18 is introduced into the hot separator 28. Preferably, the hot separator includes an upper packed bed 39A (for trapping material heavier than diesel), a lower packed bed 39B (for stripping the feed going downstream via stream 46 to reduce the sulfur and nitrogen compounds therein), and a chimney tray 41 positioned between the upper and lower packed beds (for allowing gas to pass upwardly through one or more opening therein, while collecting liquid to be passed through a pump around circuit 29). The hot separator of this embodiment operates at a temperature within the range of 220° C. to 250° C., and at a pressure corresponding to that of the hydrotreating unit 22 (such as, 35-50 kg/cm$^2$g, for example).

The pump around circuit 29 is provided to the upper portion of the hot separator 28. This pump around circuit 29 ensures that material boiling above the diesel range does not go to the hot separator overhead vapor stream 36. More specifically, the flashed vapor rises through the opening(s) in the chimney tray 41 and contacts the pump around liquid from stream 38 across the upper packed bed 39A. This contact ensures that any hydrocarbons boiling above a threshold temperature, such as 370° C. in certain embodiments, are removed from the net vapors leaving the hot separator 28 via stream 36.

At start-up of the process, the pump around circuit 29 removes a liquid stream comprised of components with a true boiling point (TBP) in the range of 200° C.-350° C., in certain embodiments, from an upper portion of the hot separator via pump around line 32, which is configured to receive a start-up diesel stream via line 33, prior to being pumped, via pump 35, through a heat exchanger 37. As the process progresses and the reactor 22 reaches the desired temperature, the composition of the stream within line 33 gradually changes to a hydrocarbon stream (including, for example, $C_2$-$C_4$ hydrocarbons) containing compounds boiling in the range of 320° C. to 720° C., with some dissolved light end material such as hydrogen, methane, etc.

In certain embodiments, the stream within line 32 from the chimney tray 41 is at a temperature within the range of approximately 600-720° F. (315.56-382.22° C.), and could be for example, 710° F. (376.67° C.). After passing through the heat exchanger, the cooled stream 38, which is still in liquid form, and which is preferably at a temperature within the range of approximately 140-194° F. (60-90° C.), and could be, for example, 176° F. (80° C.), is then passed into the upper portion of the hot separator 28, at an elevation above line 32. The pump around circuit 29 also includes a bleed stream 40 for removing excess materials from the circuit.

Within the hot separator 28, the stream 18 is separated into the vapor stream 36, which includes hydrogen, and a liquid stream 46. The liquid stream 46 comprises treated vacuum gas oil, which is sent for further processing, such as to a hydrocracker of a fluid catalytic cracking unit (not shown).

The vapor stream 36 is preferably passed through a heat exchanger 48, where it is cooled, and the cooled stream 50 is combined with a wash water stream 52 to form a combined stream 53. The combined stream 53 is run through a cooling unit 54 (such as a fin-fan, or other desired cooling device) to form a further cooled stream 56, which is provided to the cold separator 30. The stream 56 is preferably at a temperature within the range of 55-65° C., in certain embodiments. The cold separator 30 separates the stream 56 into a heavy liquid stream 58 (including, for example, $H_2$, $CH_4$, ethane, propane, butane and hydrocarbons boiling up to 370° C. (TBP)), a light liquid stream 60 (including, for example, $C_5$ hydrocarbons and compounds boiling up to 370° C. (TBP)), and a vapor stream 64 (including, for example, $H_2$, $CH_4$, $H_2O$, ethane, propane and butane).

The vapor stream 64 is passed into an amine scrubber 66, which receives an amine solution via line 67 and creates a rich amine stream 68 and an overhead gas stream 70. The overhead gas stream 70, which has had the hydrogen sulfide and carbon dioxide removed, is passed through recycle gas compressor 72, and is in communication with a make-up gas stream 74, which provides make-up gas, such as hydrogen. The combined stream 16 is the stream mentioned above that branches into streams 16A, 16A', 16A", 16B and 16C.

Figure 2:
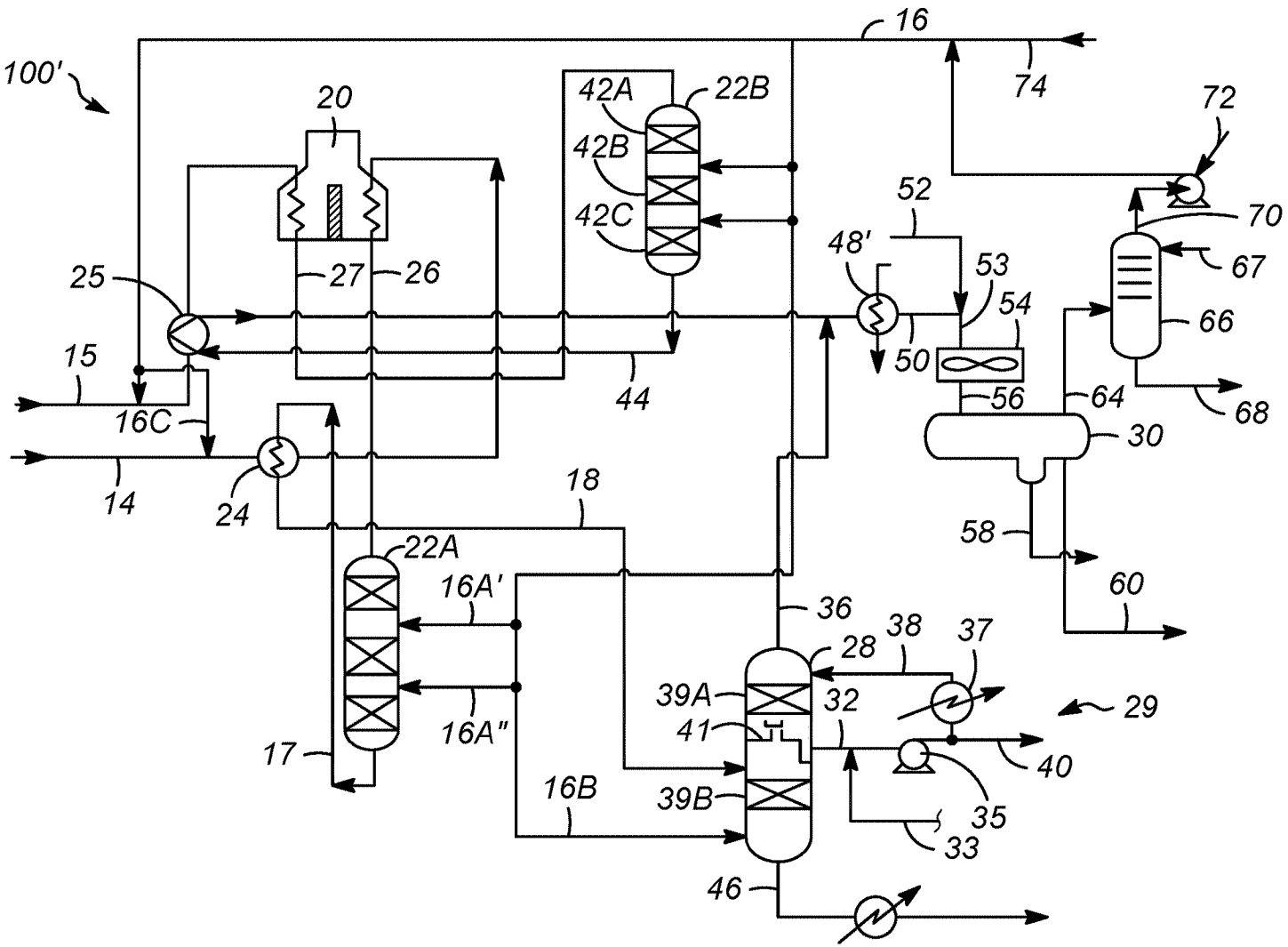
FIG. 2 depicts an example of a second embodiment of the present invention.

Turning now to FIG. 2, a second embodiment of the present invention, designated as hydrotreating system 100' is shown and will be described. In the FIG. 2 embodiment, components that are the same, or very similar, to those of the first embodiment of FIG. 1 are designated with the same reference numbers, and need not be discussed further. One of the primary differences between the FIG. 2 embodiment and the FIG. 1 embodiment is that the FIG. 2 embodiment includes two hydrotreating units, which will be designated as 22A and 22B. Another important difference is that the FIG. 2 embodiment is configured and arranged for co-processing a first hydrocarbon feed stream 14, such as a VGO stream, as well as a second hydrocarbon feed stream 15, such as a diesel stream. The second hydrocarbon feed stream 15 passes through a heat exchanger 25 and a heating apparatus 20, then this heated stream 27, which is at a temperature within the range of, for example, 350-410° C., is routed through the hydrotreating unit 22B. It should be noted that the heating apparatus 20 used for heating the second hydrocarbon stream 15 shown in FIG. 2 is the same heating apparatus used for heating the first hydrocarbon stream 14. However, it is contemplated that two different heating apparatuses could be used, with one heating apparatus heating stream 14 and another heating apparatus heating steam 15.

The hydrotreating unit 22B preferably, includes multiple catalyst beds, such as 42A, 42B, 42C. Although three beds are shown, it is contemplated that fewer than three beds (such as two beds), or more than three beds could be utilized. The catalyst in the lowermost bed, which in this case is bed 42C, preferably comprises an all metal catalyst, such as catalysts consist of a Group VI metal component selected from molybdenum, tungsten, and mixtures thereof, a Group V metal component selected from vanadium, niobium, tantalum, and mixtures thereof, and a Group VIII metal component selected from nickel, cobalt, iron, and mixtures thereof. The metal components (in the form of oxides) preferably constitute up to 40-50 wt. % of the catalyst.

The catalyst in the remainder of the beds, such as beds 42A and 42B, could be any desired type of catalyst, such as catalysts containing combinations of metals as mentioned above provided on a suitable support.

Within the reactor 22B, the heated diesel stream 27 is hydrotreated under hydrotreating conditions and at a pressure within the range of approximately 35-50 kg/cm$^2$g to form a hydrotreated effluent stream 44. The effluent stream 44 from the hydrotreating unit 22B, which will comprise, for example, $H_2$, $CH_4$, ethane and hydrocarbons boiling up until 725° C. (TBP), need not pass through the hot separator 28, but instead can be combined with the vapor stream 36 from the hydrotreating unit 22A in the cold separator 30, after being cooled by passing through heat exchanger 25. The stream formed by combining bottoms streams 36 and 44 can be routed to pass through heat exchanger 48', to remove additional heat, and the cooled stream 50 can be combined with a wash water stream 52 to form a combined stream 53 that enters the cooling unit 54. After the cooling unit 54, the processing is essentially the same as in the first embodiment of FIG. 1.

Figure 3:
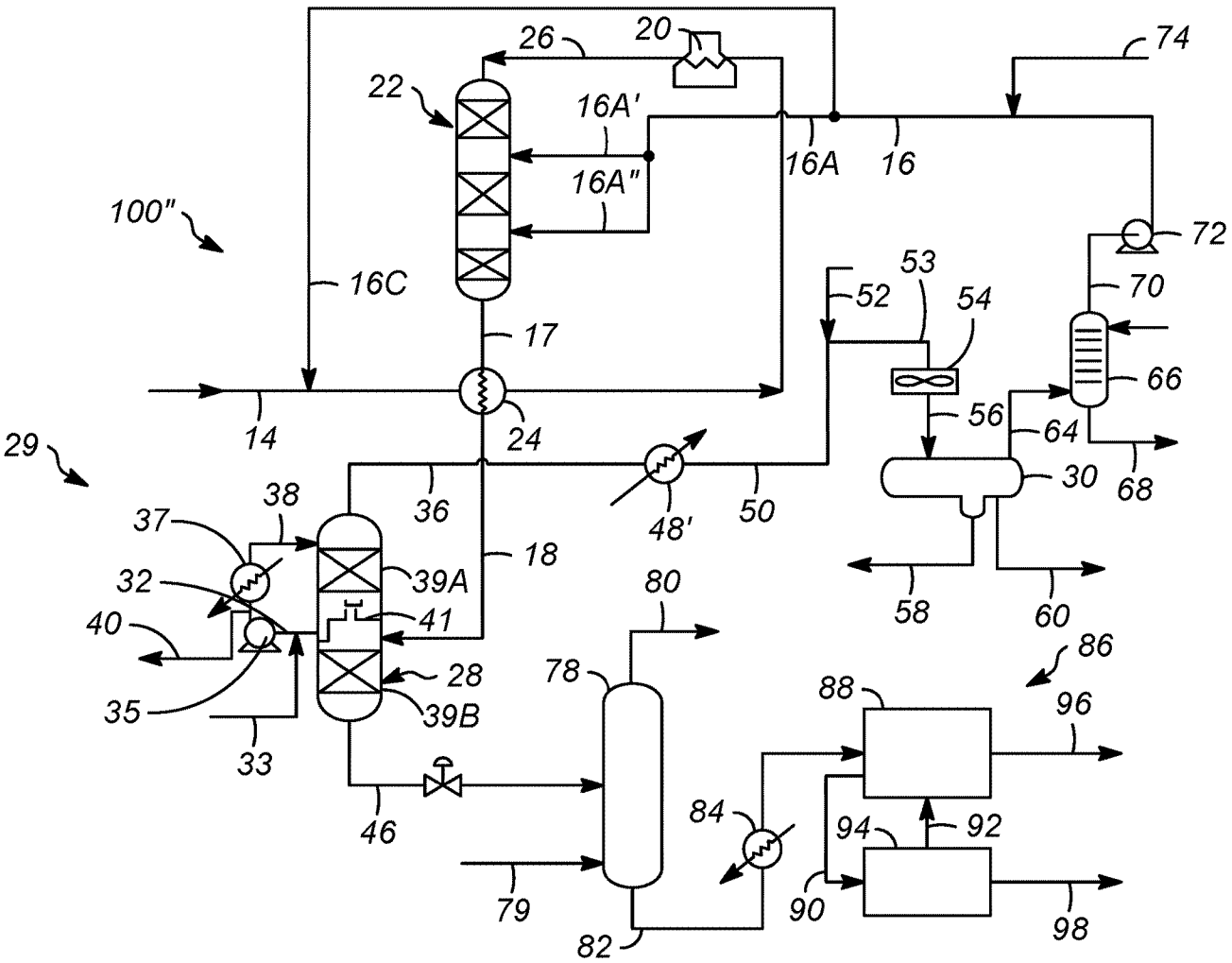
FIG. 3 depicts an example of a third embodiment of the present invention.

Turning now to FIG. 3, a third embodiment of the present invention, designated as hydrotreating system 100" is shown and will be described. In the FIG. 3 embodiment, components that are the same, or very similar, to those of the first embodiment of FIG. 1 are designated with the same reference numbers, and need not be discussed further. One of the primary differences between the FIG. 3 embodiment and the FIG. 1 embodiment relates to the further processing of the liquid effluent stream 46 from the hot separator 28.

In the FIG. 3 embodiment, a separate stripper 78 is provided for the hot separator bottoms 46. The stripper 78 receives a stripping medium, such as steam, via line 79. The stripped and treated VGO stream 82 exiting from the stripper 78 is cooled via heat exchanger 84, and is then treated with ionic liquid in an ionic liquid treatment zone 86, which includes, inter alia, an ionic liquid treater reactor 88 and an ionic liquid regenerator apparatus 94. The ionic liquid treating within zone 86 further reduces the nitrogen, metals and CCR (Conradson Carbon Residue) of the VGO, and makes it easier to process in the downstream unit(s) (such as a hydrocracking unit, a fluid catalytic cracking unit, etc.). The ionic liquid used within the ionic liquid treatment zone 86 can be, for example, be imidazolium-based, phosphonium-based or guanidinium-based. The resulting streams from the ionic liquid treatment zone include a treated VGO stream 96 and an extract stream 98, which could be directed to a delayed coker.

While various embodiments of the present invention have been shown and described, it should be understood that other modifications, substitutions and alternatives may be apparent to one of ordinary skill in the art. Such modifications, substitutions and alternatives can be made without departing from the spirit and scope of the invention, which should be determined from the appended claims. Various features of the invention are set forth in the appended claims.

SPECIFIC EMBODIMENTS

While the following is described in conjunction with specific embodiments, it will be understood that this description is intended to illustrate and not limit the scope of the preceding description and the appended claims.

A first embodiment of the invention is a process comprising providing a vacuum gas oil stream; heating the vacuum gas oil stream; passing the heated vacuum gas oil stream to a hydrotreating reactor; hydrotreating the heated vacuum gas oil stream under hydrotreating conditions and at a pressure within the range of approximately 35-50 kg/cm$^2$g to form a hydrotreated effluent; passing the hydrotreated effluent to a hot separator to form a gas stream and a liquid stream; passing the gas stream to a cold separator to form a heavy liquid stream, a light liquid stream and a vapor stream; passing the vapor stream to an amine scrubber. An embodiment of the invention is one, any or all of prior embodiments in this paragraph up through the first embodiment in this paragraph, wherein the hydrotreating reactor is operated at a temperature within the range of approximately 350-410° C. An embodiment of the invention is one, any or all of prior embodiments in this paragraph up through the first embodiment in this paragraph, wherein the hydrotreating reactor includes at least one catalyst bed, and further wherein the at least one catalyst bed includes an all metal catalyst in which the metal components, in the form of oxides, constitute between approximately 40-50 wt. % of the catalyst. An embodiment of the invention is one, any or all of prior embodiments in this paragraph up through the first embodiment in this paragraph, further comprising providing a diesel stream; heating the diesel stream; passing the diesel stream to a second hydrotreating reactor; hydrotreating the heated diesel stream under hydrotreating conditions and at a pressure within the range of approximately 35-50 kg/cm$^2$g within the second hydrotreating reactor to form a hydrotreated diesel effluent; and passing the hydrotreated diesel effluent of the second hydrotreating reactor to the hot separator, whereby the hydrotreated diesel effluent of the second hydrotreating reactor is combined with the hydrotreated effluent of the hydrotreating reactor, thereby forming the gas stream and the liquid stream. An embodiment of the invention is one, any or all of prior embodiments in this paragraph up through the first embodiment in this paragraph, wherein the second hydrotreating reactor includes a plurality of catalyst beds, and further wherein a lowermost one of the plurality of catalyst bed includes an all metal catalyst in which the metal components, in the form of oxides, constitute between approximately 40-50 wt. % of the catalyst. An embodiment of the invention is one, any or all of prior embodiments in this paragraph up through the first embodiment in this paragraph, wherein the hydrotreating reactor includes at least one catalyst bed, and further wherein the at least one catalyst bed includes an all metal catalyst in which the metal components, in the form of oxides, constitute between approximately 40-50 wt. % of the catalyst. An embodiment of the invention is one, any or all of prior embodiments in this paragraph up through the first embodiment in this paragraph, wherein the step of heating the diesel stream and said step of heating the vacuum gas oil stream are performed using the same heating apparatus. An embodiment of the invention is one, any or all of prior embodiments in this paragraph up through the first embodiment in this paragraph, further comprising routing the liquid stream from the hot separator to a stripper to form a stripper bottoms stream and a stripper overhead stream; and routing the stripper bottoms stream to an ionic liquid treating zone to strip nitrogen and metals therefrom.

A second embodiment of the invention is a process comprising providing a vacuum gas oil stream; heating the vacuum gas oil stream; passing the heated vacuum gas oil stream to a hydrotreating reactor; hydrotreating the heated vacuum gas oils stream under hydrotreating conditions and at a pressure within the range of approximately 35-50 kg/cm$^2$g to form a hydrotreated effluent; and passing the hydrotreated effluent to a hot separator to form a hot separator gas stream and a hot separator liquid stream; wherein the hot separator includes a pump around circuit that removes a pump around liquid stream from an upper portion of the hot separator via a pump around line, and further wherein the pump around liquid stream is cooled to form a cooled stream, which is routed back into the hot separator at an elevation above where the pump around liquid stream exited the hot separator. An embodiment of the invention is one, any or all of prior embodiments in this paragraph up through the second embodiment in this paragraph, wherein the hydrotreating reactor includes at least one catalyst bed, and further wherein the at least one catalyst bed includes an all metal catalyst in which the metal components, in the form of oxides, constitute between approximately 40-50 wt. % of the catalyst. An embodiment of the invention is one, any or all of prior embodiments in this paragraph up through the second embodiment in this paragraph, further comprising providing a diesel stream; heating the diesel stream; passing the diesel stream to a second hydrotreating reactor; hydrotreating the heated diesel stream under hydrotreating conditions and at a pressure within the range of approximately 35-50 kg/cm$^2$g within the second hydrotreating reactor to form a hydrotreated diesel effluent; and passing the hydrotreated diesel effluent of the second hydrotreating reactor to the hot separator, whereby the hydrotreated diesel effluent of the second hydrotreating reactor is combined with the hydrotreated effluent of the hydrotreating reactor, thereby forming the gas stream and the liquid stream. An embodiment of the invention is one, any or all of prior embodiments in this paragraph up through the second embodiment in this paragraph, wherein the second hydrotreating reactor includes a plurality of catalyst beds, and further wherein a lowermost one of the plurality of catalyst bed includes an all metal catalyst in which the metal components, in the form of oxides, constitute between approximately 40-50 wt. % of the catalyst. An embodiment of the invention is one, any or all of prior embodiments in this paragraph up through the second embodiment in this paragraph, wherein the hydrotreating reactor includes at least one catalyst bed, and further wherein the at least one catalyst bed includes an all metal catalyst in which the metal components, in the form of oxides, constitute between approximately 40-50 wt. % of the catalyst. An embodiment of the invention is one, any or all of prior embodiments in this paragraph up through the second embodiment in this paragraph, wherein the step of heating the diesel stream and said step of heating the vacuum gas oil stream are performed using the same heating apparatus. An embodiment of the invention is one, any or all of prior embodiments in this paragraph up through the second embodiment in this paragraph, further comprising routing the liquid stream from the hot separator to a stripper to form a stripper bottoms stream and a stripper overhead stream; and routing the stripper bottoms stream to an ionic liquid treating zone to strip nitrogen and metals therefrom.

A third embodiment of the invention is a system comprising a vacuum gas oil feed line for providing a vacuum gas oil stream to the unit; a heater for heating the vacuum gas oil stream; a hydrotreating reactor; a line for passing the heated vacuum gas oil stream to the hydrotreating reactor; a hot separator; a line for passing the hydrotreated effluent to the hot separator to form a gas stream and a liquid stream; a cold separator; a line for passing the gas stream to the cold separator to form a heavy liquid stream, a light liquid stream and a vapor stream; an amine scrubber; a line for passing the vapor stream from the cold separator to the amine scrubber. An embodiment of the invention is one, any or all of prior embodiments in this paragraph up through the third embodiment in this paragraph, wherein the hydrotreating reactor is operated at a pressure within the range of approximately 35-50 kg/cm$^2$g. An embodiment of the invention is one, any or all of prior embodiments in this paragraph up through the third embodiment in this paragraph, wherein the hydrotreating reactor includes at least one catalyst bed, and further wherein the at least one catalyst bed includes all metal catalysts in which the metal components, in the form of oxides, constitute between approximately 40-50 wt. % of the catalyst. An embodiment of the invention is one, any or all of prior embodiments in this paragraph up through the third embodiment in this paragraph, further comprising a diesel stream line for providing a diesel stream; a heater for heating the diesel stream; a line for passing the diesel stream to a second hydrotreating reactor; and a line for passing the hydrotreated effluent of the second hydrotreating reactor to the hot separator, whereby the hydrotreated effluent of the second hydrotreating reactor is combined with the hydrotreated effluent of the hydrotreating reactor, thereby forming the gas stream and the liquid stream. An embodiment of the invention is one, any or all of prior embodiments in this paragraph up through the third embodiment in this paragraph, further comprising a line for routing the liquid stream from the hot separator to a stripper to form a stripper bottoms stream and a stripper overhead stream; and a line for routing the stripper bottoms stream to an ionic liquid treating zone to strip nitrogen and metals therefrom.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A hydrotreating process comprising:

providing a vacuum gas oil stream;

heating the vacuum gas oil stream;

passing the heated vacuum gas oil stream to a hydrotreating reactor;

hydrotreating the heated vacuum gas oil stream under hydrotreating conditions and at a pressure within the range of approximately 35-50 kg/cm$^2$g to form a hydrotreated effluent, wherein the hydrotreating reactor includes at least one catalyst bed, and further wherein said at least one catalyst bed includes an all metal catalyst in which the metal components, in the form of oxides, constitute between approximately 40-50 wt. % of the catalyst;

passing the hydrotreated effluent to a hot separator to form a gas stream and a liquid stream, wherein a pump around circuit is provided in a top section of the hot separator to remove a pump around liquid stream from an upper portion of the hot separator via a pump around line, and further wherein the pump around liquid stream is cooled to form a cooled stream, which is routed back into the hot separator;

passing the gas stream to a cold separator to form a heavy liquid stream, a light liquid stream and a vapor stream; and passing the vapor stream to an amine scrubber.

2. The hydrotreating process according to claim 1, wherein the hydrotreating reactor is operated at a temperature within the range of approximately 350-410° C.

3. The hydrotreating process according to claim 1, further comprising:

providing a diesel stream;

heating the diesel stream;

passing the diesel stream to a second hydrotreating reactor;

hydrotreating the heated diesel stream under hydrotreating conditions and at a pressure within the range of approximately 35-50 kg/cm$^2$g within the second hydrotreating reactor to form a hydrotreated diesel effluent; and passing the hydrotreated diesel effluent of the second hydrotreating reactor to said cold separator, whereby said hydrotreated diesel effluent of said second hydrotreating reactor is combined with said hydrotreated effluent of said hydrotreating reactor, thereby forming said vapor stream, said heavy liquid stream and said light liquid stream.

4. The hydrotreating process according to claim 3, wherein the second hydrotreating reactor includes a plurality of catalyst beds, and further wherein a lowermost one of said plurality of catalyst bed includes an all metal catalyst in which the metal components, in the form of oxides, constitute between approximately 40-50 wt. % of the catalyst.

5. The hydrotreating process according to claim 3, wherein said step of heating the diesel stream and said step of heating the vacuum gas oil stream are performed using the same heating apparatus.

6. The hydrotreating process according to claim 1, further comprising:

routing said liquid stream from said hot separator to a stripper to form a stripper bottoms stream and a stripper overhead stream; and routing said stripper bottoms stream to an ionic liquid treating zone to strip nitrogen and metals therefrom.

7. A hydrotreating process comprising:

providing a vacuum gas oil stream;

heating the vacuum gas oil stream;

passing the heated vacuum gas oil stream to a hydrotreating reactor;

hydrotreating the heated vacuum gas oils stream under hydrotreating conditions and at a pressure within the range of approximately 35-50 kg/cm$^2$g to form a hydrotreated effluent; and passing the hydrotreated effluent to a hot separator to form a hot separator gas stream and a hot separator liquid stream; and wherein said hot separator includes a pump around circuit in a top section of said hot separator that removes a pump around liquid stream from an upper portion of the hot separator via a pump around line, and further wherein the pump around liquid stream is cooled to form a cooled stream, which is routed back into the hot separator at an elevation above where the pump around liquid stream exited the hot separator.

8. The hydrotreating process according to claim 7, wherein the hydrotreating reactor includes at least one catalyst bed, and further wherein said at least one catalyst bed includes an all metal catalyst in which the metal components, in the form of oxides, constitute between approximately 40-50 wt. % of the catalyst.

9. The hydrotreating process according to claim 7, further comprising:

providing a diesel stream;

heating the diesel stream;

passing the diesel stream to a second hydrotreating reactor;

hydrotreating the heated diesel stream under hydrotreating conditions and at a pressure within the range of approximately 35-50 $kg/cm^2g$ within the second hydrotreating reactor to form a hydrotreated diesel effluent; and passing the hydrotreated diesel effluent of the second hydrotreating reactor to said hot separator, whereby said hydrotreated diesel effluent of said second hydrotreating reactor is combined with said hydrotreated effluent of said hydrotreating reactor, thereby forming said gas stream and said liquid stream.

10. The hydrotreating process according to claim 9, wherein the second hydrotreating reactor includes a plurality of catalyst beds, and further wherein a lowermost one of said plurality of catalyst bed includes an all metal catalyst in which the metal components, in the form of oxides, constitute between approximately 40-50 wt. % of the catalyst.

11. The hydrotreating process according to claim 10, wherein the hydrotreating reactor includes at least one catalyst bed, and further wherein said at least one catalyst bed includes an all metal catalyst in which the metal components, in the form of oxides, constitute between approximately 40-50 wt. % of the catalyst.

12. The hydrotreating process according to claim 9, wherein said step of heating the diesel stream and said step of heating the vacuum gas oil stream are performed using the same heating apparatus.

13. The hydrotreating process according to claim 7, further comprising:

routing said liquid stream from said hot separator to a stripper to form a stripper bottoms stream and a stripper overhead stream; and routing said stripper bottoms stream to an ionic liquid treating zone to strip nitrogen and metals therefrom.

* * * * *